US006082273A

United States Patent [19]

Christ et al.

[11] Patent Number: 6,082,273

[45] Date of Patent: Jul. 4, 2000

[54] METHOD FOR OPERATING A CORNER BURNER FOR A TANGENTIAL BURNER SYSTEM AND CORNER BURNER FOR PERFORMING THE METHOD

[75] Inventors: Werner Christ, Wiehi; Wolfgang Schreier, Gummersbach, both of Germany

[73] Assignee: L. & C. Steinmuller GmbH, Germany

[21] Appl. No.: 09/210,516

[22] Filed: Dec. 11, 1998

[30] Foreign Application Priority Data

Jul. 22, 1997 [DE] Germany ..... 197 31 474
Jun. 17, 1998 [WO] WIPO ..... PCT/EP98/03655

[51] Int. Cl.[7] ..... F23D 1/04; F23C 5/00; F23C 5/32

[52] U.S. Cl. ..... 110/347; 110/264; 431/8; 431/9; 431/10; 431/173; 431/175

[58] Field of Search ..... 431/2, 5, 8, 9, 431/10, 12, 173, 174, 175, 176; 110/348, 260, 262, 263, 264, 265, 266, 347, 261

[56] References Cited

U.S. PATENT DOCUMENTS 4,425,855 1/1984 Chadshay .
4,569,311 2/1986 Lilinares, Jr. .
5,315,939 5/1994 Rini et al. .

FOREIGN PATENT DOCUMENTS 0022454 1/1981 European Pat. Off. .
63070005 9/1986 European Pat. Off. .
972968 12/1953 Germany .
1753186 A1 8/1992 U.S.S.R. ..... 110/264

*Primary Examiner*—Ira S. Lazarus
*Assistant Examiner*—Ljiljana V. Ciric
*Attorney, Agent, or Firm*—Robert W. Becker & Associates

[57] ABSTRACT

In a method for operating a corner burner of a tangential burner system, at least a first air stream of coal dust and primary air is tangentially introduced to a imaginary horizontal circle in the combustion chamber of the tangential burner system via a nozzle of the corner burner. An additional air stream is introduced into the combustion chamber in a direction toward a chamber wall of the combustion chamber at an adjustable offset angle relative to the first air stream. The offset angle can be adjusted by providing the additional air stream as mixed air stream of at least two partial air streams of different adjustable flow velocity. A first partial air stream within the nozzle flows straight into the outlet opening of the nozzle, and the second partial air stream flows angularly into the first partial air stream upstream of the outlet opening. The nozzle has a mixing chamber arranged upstream of the outlet opening. The mixing chamber has a slanted wall and a parallel wall such that the mixing chamber widens in the direction away from the outlet opening. At least two air inlet channels are connected to the mixing chamber remote from the outlet opening. A first air inlet channel is arranged such that a first partial stream air exiting from the first inlet channel flows straight into the outlet opening and a second air inlet channel is arranged such that a second partial air stream exiting from the second air inlet channel is directed onto the slanted wall and deflected at the slanted wall into the first partial air stream. The flow velocity of the first and second partial air streams is adjustable.

9 Claims, 2 Drawing Sheets

METHOD FOR OPERATING A CORNER BURNER FOR A TANGENTIAL BURNER SYSTEM AND CORNER BURNER FOR PERFORMING THE METHOD

BACKGROUND OF THE INVENTION

The present invention relates to a method for operating a corner burner for a tangential burner system in which via the corner burner at least one stream of coal dust and primary air and optionally a further stream of combustion air and/or returned flue gas is tangentially introduced onto an imaginary and substantially horizontal circle within the combustion chamber of the tangentially burner system. At least one further air stream (wall air stream) is introduced by a nozzle of the corner burner at an adjustable off set angle relative to the stream of coal dust and primary air into the combustion chamber in a direction toward a wall of the combustion chamber.

From European patent document EP 22 454 B1 such a method is known in which a secondary air stream is introduced into the combustion chamber such that the secondary air stream is oriented tangentially onto a second imaginary circle which is spaced at a distance coaxially and radially outwardly to the first imaginary circle. The secondary air stream is designed to produce an oxidizing atmosphere along the combustion chamber walls in order to reduce thus the formation of slack and corrosion at the respective combustion chamber wall. Preferably, the nozzle for the stream of coal dust and primary air and the nozzle for the secondary air stream are vertically arranged above one another, as is, for example shown in FIG. 5 of EP 22 454 B1. The orientation of the secondary air stream onto a second imaginary circle corresponds to an offset angle of the secondary air stream relative to the flow of coal dust and primary air in the direction onto the wall of the combustion chamber. According to column 5, lines 50–59, of this printed document, the nozzle is provided with a pivoting device for the additional air stream (secondary air stream or wall air stream).

Such mechanical pivoting devices are complicated in their manufacture and are disadvantageously exposed to the high combustion chamber temperatures.

It is therefore an object of the present invention to provide a method for operating a corner burner of a tangential burner system with which the adjustability of the secondary air stream (wall air stream) is possible without mechanical pivoting devices.

SUMMARY OF THE INVENTION

The object is inventively solved in that the offset angle of the secondary air stream is produced by a mixture of at least two partial air streams having different flow velocities whereby one of the partial air streams flows straight onto the outlet opening of the nozzle and the other partial air stream is deflected upstream of the outlet opening at an angle into the first partial air stream. The flow velocities of the two partial air streams can be changed.

By changing the flow velocities of the two partial air streams that have different flow direction and flow velocities and are mixed upstream of the outlet opening of the nozzle, the exit angle of the mixed air stream exiting from the outlet opening of the nozzle can be adjusted continuously. Mechanical adjusting elements at the outlet opening of the nozzle are no longer required.

The invention is also directed to a corner burner with at least one nozzle for introduction of the stream of coal dust and primary air and at least one nozzle for the introduction of a further (secondary) air stream (wall air stream) at an adjustable offset angle relative to the stream of coal dust and primary air.

The inventive device has a mixing chamber upstream of the outlet opening of the nozzle whereby the mixing chamber has a parallel wall extending parallel to the central axis of the outlet opening and also has a slanted wall positioned angularly relative to the central axis. The mixing chamber thus widens in a direction away from the outlet opening and has connected at the remote end (away from the outlet opening) at least two air inlet channels such that one partial air stream exiting from one of the channels is directed directly onto the outlet opening and the other partial air stream exiting from the other air inlet channel impinges on the slanted wall, is deflected threat, and is thus mixed into the first partial air stream. The flow velocities of the two partial air streams are adjustable.

Preferably, the two air stream channels are formed by a single air inlet pipe with an internally arranged partition which ends at the connecting location between the mixing chamber and the air inlet pipe.

An especially simple embodiment is provided when the air inlet channels have substantially identical cross-sections.

It is furthermore expedient when, as is known from the prior art, in the mounted position of the corner burner the nozzle for introducing the stream of coal dust and primary air and the second nozzle (wall air nozzle) are arranged above one another.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 1:
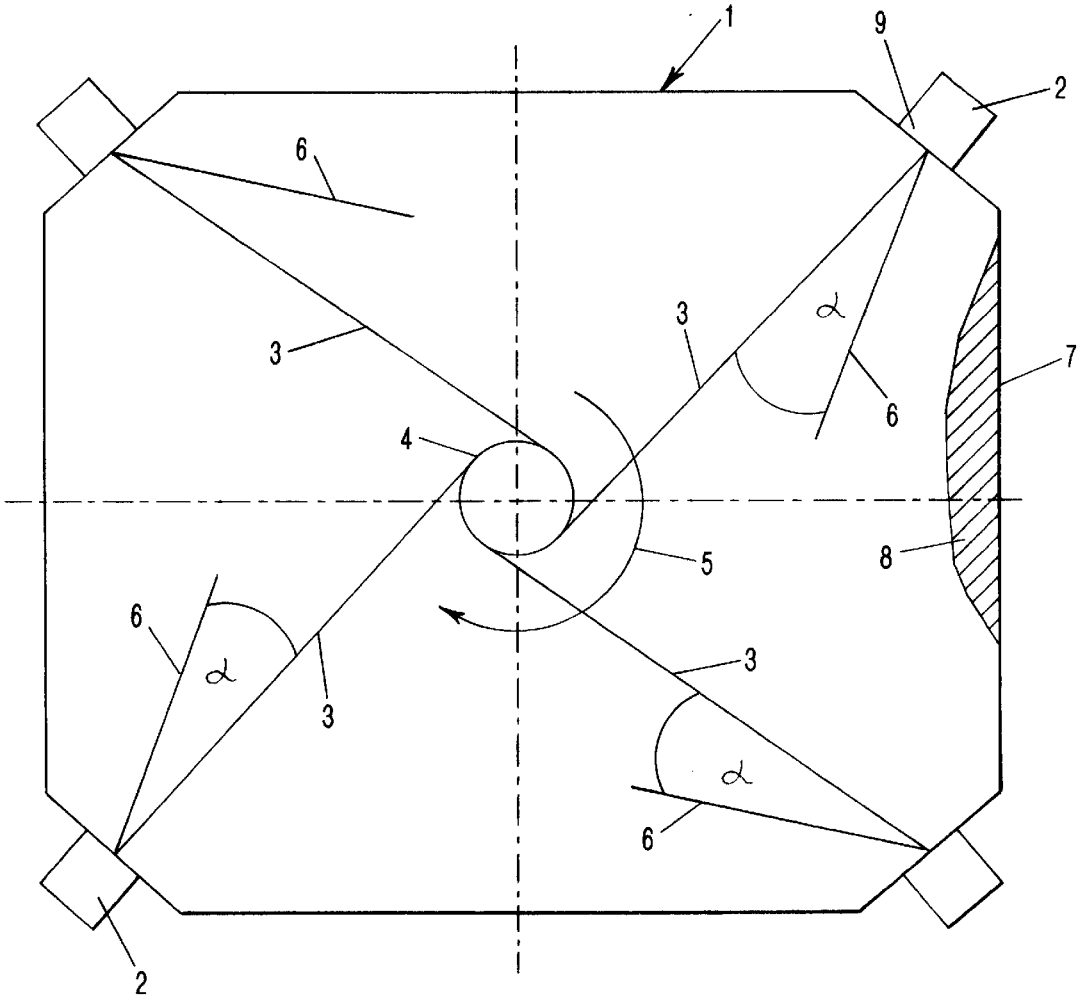
FIG. 1 shows a horizontal section of the combustion chamber of a tangential burner system.

The present invention will now be described in detail with the aid of several specific embodiments utilizing FIGS. 1–4. FIG. 1 shows a horizontal cross-sectional view of a combustion chamber 1 of a tangential burner system, whereby the view is not to scale. The four corners of the combustion chamber are provided with corner burners 2. Each corner burner 2 has at least one nozzle for introducing an air stream 3 of coal dust and primary air into the combustion chamber. The coal dust-primary air stream 3 of each corner burner 2 is directed tangentially onto an imaginary circle 4 which is arranged concentrically to the vertical axis of the combustion chamber. Due to this arrangement the indicated combustion whirl 5 results during operation of the combustion chamber. At an offset angle a of for example 25° an additional air stream 6 is introduced by at least one wall air nozzle 9 of the corner burner 2 such that it enters between the first air stream 3 and enabling combustion chamber walls 7 in order to produce in the area 8 of the combustion chamber wall 7 an oxidizing atmosphere to reduce or avoid slack formation and corrosion of the wall 7. It is expedient to have an adjustable offset angle $\alpha$.

Figure 2:
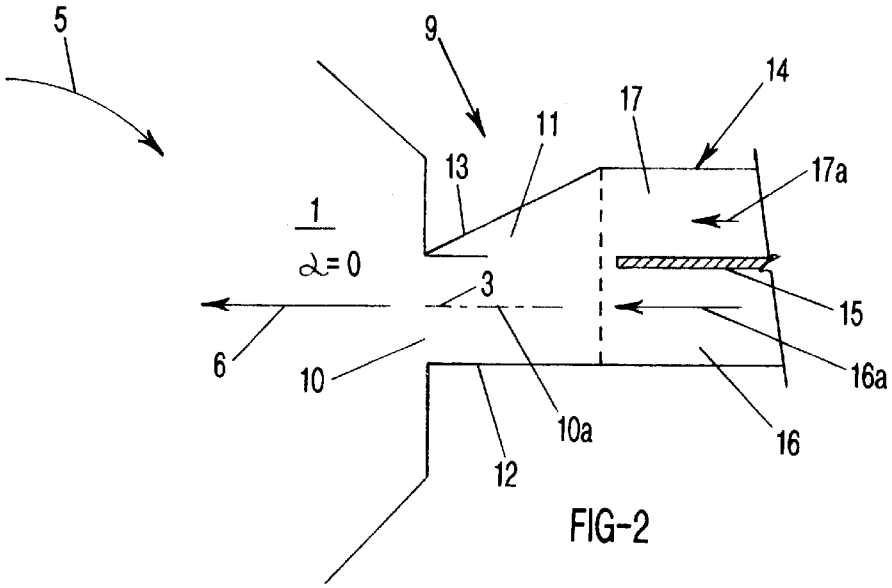
FIGS. 2–4 show schematical horizontal sections of the combustion chamber and a wall air nozzle of a corner burner for explaining the different loading states of the wall air nozzle.
Figure 3:
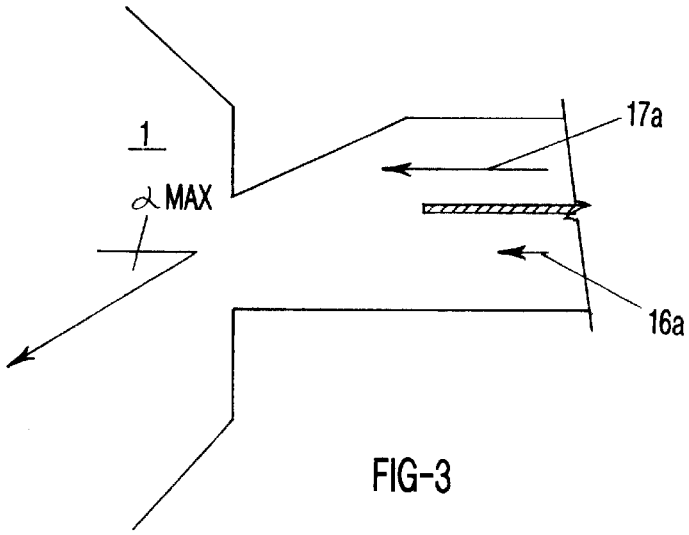
Figure 4:
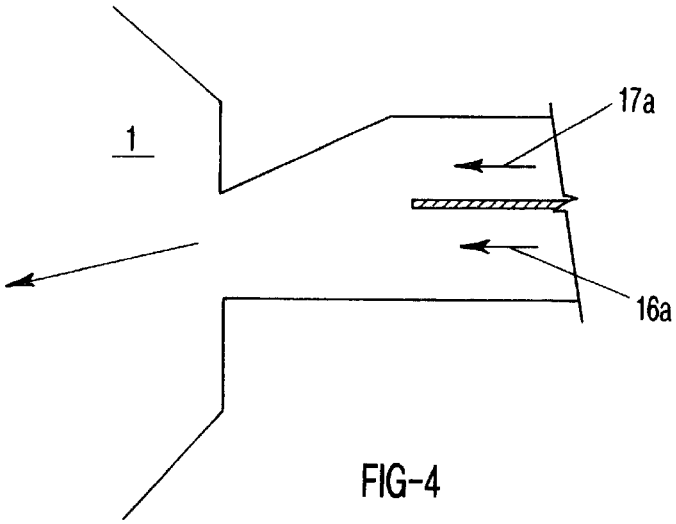

In FIGS. 2–4 a horizontal section of a wall air nozzle 9 of the corner burner 2 is represented which is arranged above or below the coal dust-primary air nozzle. The outlet opening 10 with central axis 10*a* has positioned upstream thereof a mixing chamber 11. The mixing chamber 11 is defined by a vertically extending parallel wall 12 that is parallel to the central axis 10*a* and begins at the outlet opening 10. A slanted wall 13 also begins at the outlet opening 10 and extends angularly relative to the central axis 10*a*. The mixing chamber 11 thus widens in a direction away from the outlet opening 10. To the remote end of the mixing chamber 11 an air inlet pipe 14 is connected which is divided by a partition 15 into an air inlet channel 16 and an air inlet channel 17. The air inlet channel 16 is substantially oriented directly onto the outlet opening 10, and the air inlet channel 17 is directed onto the inner side of the slanted wall 13.

The two channels 16 and 17 have preferably the same flow cross-section. The partition 15 is preferably directed toward the upper edge of the outlet opening (see FIGS. 2–4) and ends preferably in the connecting area between the mixing chamber 11 and the air inlet pipe 14. The wall 12 can, of course, also be an extension of a corresponding wall of the pipe 14.

The offset angle $\alpha$ is produced by loading the air inlet channels 16 and 17 with partial air streams 16*a*, 17*a* of different velocity. The arrow symbols shown in the Figures represent with their length the magnitude of the velocity. The outlet orientation is also determined by the slant angle $\beta$ of the wall 13. When loading the nozzle with different partial air streams 16*a*, 17*a* according to FIG. 2, the offset angle $\alpha$ is 0 i.e., the additional or wall air stream 6 exits in the direction of main combustion, i.e., in the direction of stream 3, from the nozzle 9. When loading the nozzle according to FIG. 3, the wall air stream 6 will exit at the maximum possible angle which is somewhat smaller than the slant angle $\beta$ of the wall 13 since in the less loaded partial inlet channel (17 in FIG. 2 and 16 in FIG. 3) a certain amount of air is still flowing in order to cool the respective channel.

When the two channels 16 and 17 are uniformly loaded according to FIG. 4, an average deflection angle of the wall air flow 6 is achieved. The delimiting surfaces (walls) of the mixing chamber 11 parallel to the plane of the drawings FIGS. 2–4 can be formed by parallel and horizontally spaced-apart sheet metal.

The present invention is, of course, in no way restricted to the specific disclosure of the specification and drawings, but also encompasses any modifications within the scope of the appended claims.

What is claimed is:

1. A method for operating a corner burner of a tangential burner system, said method comprising the steps of:

a) introducing via the corner burner at least a first air stream of coal dust and primary air tangentially to an imaginary horizontal circle into a combustion chamber of the tangential burner system;

b) introducing via a nozzle of the corner burner an additional air stream into the combustion chamber in a direction toward a chamber wall of the combustion chamber at an adjustable offset angle relative to said first stream;

c) adjusting said offset angle by providing said additional air stream as a mixed air stream of at least two partial air streams of different adjustable flow velocities, wherein a first one of said partial air streams within said nozzle flows straight into an outlet opening of said nozzle and wherein a second one of said partial air streams flows angularly into said first partial air stream upstream of said outlet opening.

2. A method according to claim 1, wherein in said step a) an auxiliary stream of combustion air is tangentially introduced.

3. A method according to claim 1, wherein in said step a) an auxiliary stream of returned flue gas is tangentially introduced.

4. A method according to claim 1, wherein in said step a) an auxiliary stream of combustion air and flue gas is tangentially introduced.

5. A tangential burner system with a corner burner, said tangential burner system comprising:

first means for introducing via the corner burner at least a first air stream of coal dust and primary air tangentially to an imaginary horizontal circle into a combustion chamber of the tangential burner system;

second means for introducing via a nozzle of the corner burner an additional air stream into the combustion chamber in a direction toward a chamber wall of the combustion chamber at an adjustable offset angle relative to said first stream;

third means for adjusting said offset angle by providing said additional air stream as a mixed air stream of at least two partial air streams of different adjustable flow velocities, wherein a first one of said partial air streams within said nozzle flows straight into an outlet opening of said nozzle and wherein a second one of said partial air streams flows angularly into said first partial air stream upstream of said outlet opening.

6. A tangential burner system according to claim 5, wherein:

said first means comprises at least one first nozzle for introducing the first air stream (3) of coal dust and primary air into the combustion chamber;

said second means comprising at least one second nozzle (9) for introducing the additional air stream (6) in the direction toward the chamber wall at the adjustable offset angle relative to said first air stream (3);

said at least one second nozzle (9) having an outlet opening (10) having a central axis (10*a*);

said third means comprising a mixing chamber arranged upstream of said outlet opening (10):

said mixing chamber (11) having a slanted wall (13) positioned angularly relative to said central axis (10*a*) and having a parallel wall extending parallel to said central axis (10*a*) such that said mixing chamber (11) widens in a direction away from said outlet opening (10);

said third means further comprising at least two air inlet channels (16, 17) connected to said mixing chamber (11) remote from said outlet opening (10), wherein a first one of said air inlet channels (16) is arranged such that a first partial air streams (16*a*) exiting from said first air inlet channel (16) flows straight into said outlet opening (10) and wherein a second one of said air inlet channels (17) is arranged such that a second partial air stream (17*a*) exiting from said second air inlet channel (17) is directed onto said slanted wall (13) and deflected at said slanted wall (13) into said first partial air stream (16*a*) and mixed with said first partial air stream (16*a*) to form said additional air stream exiting from said outlet opening (10), wherein a flow velocity of said first and second partial air streams (16*a*, 17*a*) is adjustable.

7. A device according to claim 6, further comprising a single inlet pipe (14) having a partition (15) dividing said single inlet pipe (14) into said first and second air inlet channels (16, 17), wherein said partition (15) ends at a connecting location of said mixing chamber and said air inlet pipe (14).

8. A device according to claim 6, wherein said air inlet channels (16, 17) have identical cross-sections.

9. A device according to claim 6, wherein said at least one first nozzle and said at least one second nozzle are positioned above one another.

* * * * *

UNITED STATES PATENT AND TRADEMARK OFFICE

CERTIFICATE OF CORRECTION

PATENT NO. : 6,082,273
DATED : July 4, 2000
INVENTOR(S) : Werner Christ and Wolfgang Schreier It is certified that error appears in the above-identified patent and that said Letters Patent is hereby corrected as shown below:

Title page,
The following item should read as follows:

[75] Inventors:
Werner Christ, Wiehl; Wolfgang Schreier, Gummersbach, both of Germany Signed and Sealed this Eighteenth Day of September, 2001

*Attest:*

Nicholas P. Godici

NICHOLAS P. GODICI
*Acting Director of the United States Patent and Trademark Office*

*Attesting Officer*